United States Patent [19]

Ritter et al.

[11] Patent Number: 4,526,025

[45] Date of Patent: Jul. 2, 1985

[54] WIRE OR STRIP BENDING MECHANISM

[75] Inventors: Klaus Ritter; Gerhard Ritter; Gerhard Schmidt; Josef Ritter, all of Graz, Austria

[73] Assignee: EVG Entwicklungs- und Verwertungs-Gesellschaft m.b.H., Graz, Austria

[21] Appl. No.: 524,299

[22] Filed: Aug. 18, 1983

[30] Foreign Application Priority Data

Aug. 23, 1982 [AT] Austria ..... 3190/82

[51] Int. Cl.[3] ..... B21D 9/05

[52] U.S. Cl. ..... 72/388; 140/105

[58] Field of Search ..... 140/102, 105, 104; 72/388, 387, 306, 307

[56] References Cited

U.S. PATENT DOCUMENTS 2,097,193 10/1937 Jacobs ..... 140/105
3,273,371 9/1966 Peterson ..... 72/388
3,803,893 4/1974 Peddinghaus et al. ..... 72/306

FOREIGN PATENT DOCUMENTS 314319 3/1979 Austria .
925404 3/1955 Fed. Rep. of Germany ..... 140/105

*Primary Examiner*—Francis S. Husar
*Assistant Examiner*—Linda McLaughlin
*Attorney, Agent, or Firm*—Ernest F. Marmorek

[57] ABSTRACT

A bending mechanism for wire or strip material is provided, which is intended in particular for bending back towards the edge longitudinal wires the projecting end portions of crosswires of reinforcement grids for reinforced concrete construction. The mechanism comprises a substantially circular-sectioned cylindrical bending form, and a bending-tool eccentrically mounted on a rotatable tool carrier which can be rotated in either direction about the axis of the bending-form. The bending-form is shiftable along said axis between a working position, in which the end faces of said tool carrier and said bending-form are substantially touching, and a rest position in which said two end faces define between them a gap for the passage of a wire which is to be bent, in particular a crosswire of a reinforcement grid.

7 Claims, 8 Drawing Figures

WIRE OR STRIP BENDING MECHANISM

The invention relates to a bending mechanism for wire or strip material, the mechanism having a stationary bending-form and a bending-tool preferably the shape of a circular-sectioned cylinder, which can be pivoted about the bending-form. The mechanism is intended in particular for bending back towards the edge longitudinal wires the projecting end portions of crosswires of reinforcement grids for reinforced concrete construction.

Bending mechanisms of this general type are known, for example from Austrian Pat. No. 314,319, issued on Mar. 25, 1974. One of these known bending mechanisms has a bending-mandrel, the shape of a circular cylinder, which during the bending process is stationary in the centre of the bending motion and which forms a bending-form which establishes the diamater of bend, and a bending-tool the shape of a circular cylinder, which can be guided round a circular path at a distance from the mandrel to bend the wire round it. The bending-mandrel and the movable bending-tool are connected together into a tool unit by a common arm. If the direction of making the bend has to be altered between successive bending processes, the whole tool unit is withdrawn in the direction perpendicular to the bending plane until the tool unit can be swivelled unimpeded under the wire into the opposite position relative to the latter.

Bending mechanisms of this kind might also be applied to the particular use of bending back, in the direction towards the edge longitudinal wires of reinforcement grids for reinforced concrete construction, the end portions of the projecting crosswires, so that they form loops. Mats of this kind are also called "loop mats". In this application the tool unit would have to be withdrawn out of the bending plane after each bending process had been concluded, in order to enable unimpeded advance of the grid and enable each new crosswire end portion to achieve the correct relative position with respect to the tool unit for the succeeding bending process. Then the tool unit would have to be advanced again into the bending plane in order to be able to perform the next bending process.

In using known bending mechanisms in this way, difficulties would arise if, as is desirable for practical reasons (say in order to avoid intermediate storage or handling of the structural steel grid which is being produced), the bending mechanisms are connected directly after the welding machine and consequently have to work in synchronism with the latter. Modern welding machines for structural steel grids are capable of welding up to 120 crosswires/min. onto the family of longitudinal wires of a grid which is being produced. In order to prevent the wire which is to be bent from sliding off the bending-form, the length of the latter in the direction perpendicular to the bending plane must of course be considerably greater than the wire diameter, which causes a correspondingly long travel for withdrawal of the tool unit out of the bending plane and for its advance into the bending plane again. In view of the extremely short time which is available for a bending process, due to the high speed of the welding machine, reliable operation could not be guaranteed with the known bending mechanisms. In this connection it also has to be borne in mind that in the case of the bending problem posed, the bending-tool must always describe an angle of pivot of about 180° round the bending form, so that it also has a very long travel.

The problem of the invention consequently is to develop further a bending mechanism of the species specified initially, in such a way that with it extremely high working speeds can be achieved with great operational safety and a long working life of the bending mechanism.

According to the present invention a bending mechanism for bending material in the form of wire or strip has a substantially circular-sectioned cylindrical bending-form, and a bending-tool mounted on a rotatable tool carrier which can be rotated in either direction about the axis of the bending-form, said bending-form having an end face, said tool carrier having an end face and said bending tool having an end face, said bending-form being shiftable along said axis between a working position in which said end faces of said tool carrier and said bending-form are substantially touching and a rest position in which said two end faces define between them a gap for the passage of a wire which is to be bent, the bending tool being eccentrically mounted on said tool carrier with respect to said axis, and said bending-tool end face being substantially coplanar with said end face of said bending-form in said rest position of said bending-form.

By such mechanism first of all there is achieved a separation between those masses of the bending mechanism which have to perform a rotary motion and a motion of translation, whereby the cycles of motion can be completed significantly more rapidly than in the case of known mechanisms. Furthermore through this construction it also becomes possible, as a result of the form of the bending-form which, with absolute safety, prevents the wire which is to be bent from slipping off, to reduce the travel which has to be covered by the bending-form to a value which is only slightly greater than the diameter of the wire which is to be bent. Therefore both measures together allow a considerable increase in the speed of operation as compared with known mechanisms.

Wires during bending often have the disagreeable characteristic of deflecting sideways out of the plane of action of the bending movement. The cause of this behaviour is the fact that wires are almost never exactly round but as a result of different influences exerted upon them during production (e.g., rolling, reeling) and handling (e.g. unreeling and straightening) exhibit slightly irregular cross-sectional profiles, the principal radii of inertia of which are unequal. If now a bending moment does not act upon such a wire exactly in the plane of one of the two principal axes of inertia then the aforesaid deflection of the wire out of the plane of bend occurs.

In the case of the production of so-called loop mats this behaviour has a particularly unfavourable effect when the end portion of crosswire which is to be bent deflects in the direction towards the plane of the longitudinal grid wires to which the crosswires are welded, because in this case under certain circumstances orderly bending is made altogether impossible through butting of the end portion of the crosswire against the edge longitudinal wire of the grid.

For removal of this difficulty, in accordance with the invention a bearing block may be provided, in which the bending-form is guided to be capable of sliding axially and which has a surface for supporting the wire which is to be bent, the said surface being at least approximately coplanar with the end face of the bending-form in the rest position of the latter, and exhibiting a groove for receiving a wire crossing at right angles the wire which is to be bent, in particular on a reinforcement grid.

Deflection of the end portion of crosswire in the direction away from the plane of the longitudinal wires, is of no consequence if the bent-round end portions of crosswire, as is usually the case, get welded again to the edge longitudinal wire in a working step succeeding the bending process. That is, the end portion of crosswire is then brought into contact with the edge longitudinal wire anyhow through the action of the welding electrodes.

In cases in which there is no provision for welding the bent-round end portions of crosswire to the edge longitudinal wires, it is advantageous to secure the end portion of crosswire also against deflection away from the plane of the longitudinal wires, which may be achieved within the scope of the invention if the bending tool is arranged on a circular carrier-disc which is coaxial with a driving shaft and is connected to the shaft so as to rotate together with it and the end face of which adjacent the wire which is to be bent is at least approximately coplanar with the end face of the bending-form in the working position of the latter.

Finally it may be of further advantage to construct the whole bending mechanism in such a way that it can be shifted by limited amounts in the direction of the longitudinal wires of the grid. Grids are often produced in which the spacings of the crosswires within one and the same grid have different dimensions. In that case the position of a bending station connected directly after the grid welding machine must be adapted during the operation of the grid welding machine to the different pitches of the crosswires. For this purpose the bending mechanism may be carried on rollers to be able to shift along rails and be equipped with devices for manual or automatic displacement along the rails.

It may further be observed that a mechanism in accordance with the invention works particularly favourably when the end portions of the crosswires are bent round into loops in the direction opposite to that of the advance of the grid. This is because in this case the grid feed can start directly after the withdrawal of the bending-form out of a shaped wire loop, while the bending-tool is still being swung back into its starting position. Not only can time thereby be saved, because the completion of the return motion of the bending tool does not first have to be awaited, but the bending-tool in this case also acts as a stop limiting the feed travel of the next crosswire and fixing the wire in its starting position for the bending process.

One example of a mechanism according to the invention will now be described more closely with reference to the accompanying drawings in which.

Figure 1:
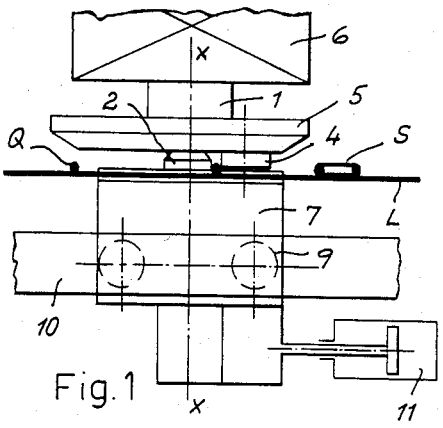
FIG. 1 is an elevation of the bending mechanism from the direction of the crosswires.

The grid which is to be worked consists of longitudinal wires L and crosswires Q, the end portions E of which, overhanging beyond the edge longitudinal wires, are to be bent into loops S. The bending mechanism has a shaft 1 which can be rotated in either direction about is axis X—X and which together with a lateral bearer-arm or, as illustrated, a disc 5 mounted on its end face, serves as carrier for the movable bending-tool 4. Opposed in axial alignment with the shaft 1 is a bending-form 2, e.g., in the form of a mandrel having a cross-section the shape of a segment of a circle (cf. the plan views of FIGS. 3 to 6). The bending-form 2 can be shifted, advantageously by a hydraulically or pneumatically driven piston 3, between a working position shown in FIGS. 1, 2 and 8, in which the endfaces of the carrier-disc 5 and the bending-form 2 preferably touch, and a rest position shown in FIG. 7, in which a gap is left between the end faces of these two components to allow the passage of a crosswire Q.

The bending-tool 4 is mounted eccentrically with respect to the common axis X—X of the shaft 1 and the bending-form 2 and is connected via the disk 5 to the shaft 1 so as to rotate together with it. The endface of the disk 5 adjacent the grid is coplanar with the end face of the bending-form in the working position of the latter.

Figure 2:
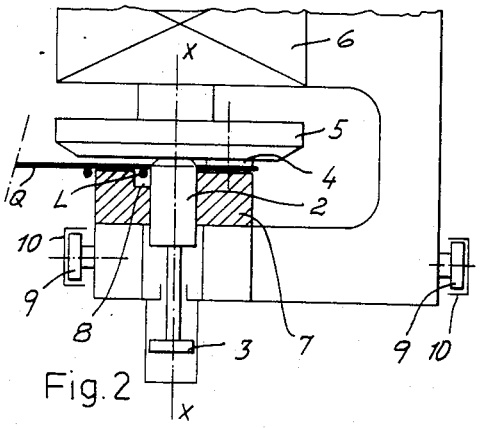
FIG. 2 is an elevation of the same mechanism from the direction of the longitudinal wires.
Figure 3:
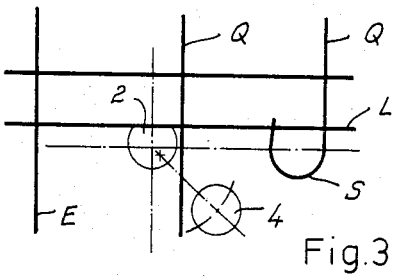
FIGS. 3 to 6 show the pivotable bending tool in different phases of the bending process.

The end face of the bending tool 4 adjacent the bending-form 2 is substantially coplanar with the end face of the bending-form lying in the rest position, so that during the bending process, as may be seen particularly clearly from FIG. 2, it can move away across the edge longitudinal wire L of the grid.

The drive of the shaft 1 in rotation is effected by a motor 6 shown only diagrammatically, for example, by a highspeed hydraulic motor via a worm and worm-wheel, but a piston drive acting via a rack on a pinion is also particularly suitable.

In a preferred embodiment of the invention the bending-form 2 is guided so as to be able to shift axially in a bearing block 7, the surface of which adjacent the grid is formed so as to support the crosswires Q of the grid, a groove 8 being recessed into this surface for receiving an edge longitudinal wire L of the grid. This supporting surface is coplanar with the end face of the bending-form in the rest position of the latter (FIG. 7).

Figure 7:
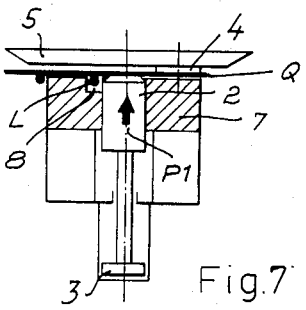
FIG. 7 shows the bending-form in its rest position at the start of its motion of engagement with the grid; and, FIG. 8 shows the bending-form in its working position at the start of its return motion.
Figure 4:
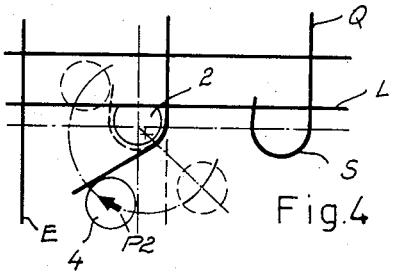
Figure 5:
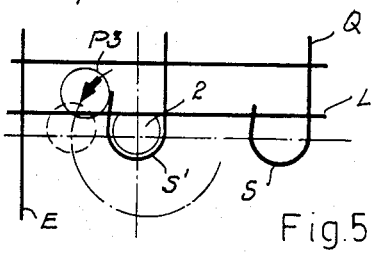
Figure 8:
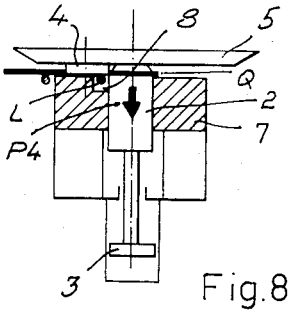
Figure 6:
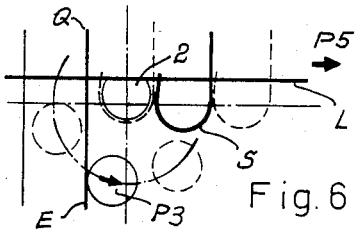

In operation, as soon as a grid crosswire Q has been advanced into the correct position for a bending process—this advance being advantageously effected directly by the feed member of the grid welding machine—the bending-form 2 is brought by the piston 3 out of its rest position in the direction of the arrow P1 in FIG. 7 into its working position (FIGS. 1 and 2), which corresponds with the starting position (shown in plan in FIG. 3) of the bending process. Then the motor 6 comes into action and pivots the bending-tool 4 in the direction of the arrow P2 in FIG. 4, so that the wire Q is bent round the bending-form 2. As soon as the bending process is finished, the bending-tool reverses its direction of motion in the direction of arrow P3 in FIG. 5 and at the same time the piston 3 withdraws the bending-form 2, in the direction of the arrow P4 in FIG. 8, into its rest position, whereby the loop S' which has just been bent is released both from the bending-tool 4 and also from the bending-form 2, to allow the grid to be advanced once more in the direction of the arrow P5 in FIG. 6. During this feed motion the next crosswire which is to bent directly follows the retreating bending-tool; thus both motions overlap in time and the bending-tool 4 forms, as soon as it has reached its end position, a stop for the crosswire Q moving forward and thus secures it in the starting position for a fresh bending process.

In the preferred embodiment the whole mechanism can shift on rollers 9 along rails 10, advantageously likewise by a hydraulically driven piston 11, parallel with the feed direction of the grid, in order to be able to adapt its working position to different pitches of cross-wires on the grid.

The control of the processes described is advantageously effected via electrohydraulic pilot valves which are controlled directly from the sequence control of the welding machine in order to synchronize the bending mechanism fully with the welding machine.

We claim:

1. A bending mechanism for bending material in the form of wire or strip, said mechanism having a substantially right circular cylindrical bending form, and a bending-tool mounted on a rotatable tool carrier which can be rotated in either direction about the axis of the bending-form, said bending-form having an end face, said tool carrier having an end face and said bending tool having an end face, said bending-form being shiftable along said axis between a working position in which said end faces of said tool carrier and said bending-form are substantially touching and a rest position in which said two end faces define between them a gap for the passage of a wire which is to be bent, said gap being only slightly larger than the thickness of the wire to bent the bending tool being eccentrically mounted on said tool carrier with respect to said axis, and said bending-tool end face being substantially coplanar with said end face of said bending-form in said rest position of said bending form.

2. A bending mechanism according to claim 1, including a bearing block, said bending-form arranged to slide axially in said bearing block and said bearing block having a surface for supporting the wire which is to be bent, said surface being substantially coplanar with said end face of said bending-form in said rest position of said bending-form, and defining a groove for receiving a wire crossing at right angles the wire which is to be bent.

3. A bending mechanism according to claim 1 wherein said tool carrier comprises a circular carrier disc and a driving shaft, said bending-tool arranged on said circular carrier-disc, said disc being coaxial with said driving shaft and connected to said shaft to rotate with it, said disc defining said tool-carrier end face.

4. A bending mechanism according to claim 1, including a plurality of rollers, a plurality of rails, said rollers rolling on said rails, and means for displacing said mechanism along the rails.

5. A bending mechanism acording to claim 1, wherein said bending tool has a substantially right circular cylindrical form.

6. A bending mechanism according to claim 4, wherein the means for displacing said mechanism along the rails, are designed for manual operation.

7. A bending mechanism according to claim 4, wherein the means for displacing said mechanism along the rails, are designed to be operated automatically.

* * * * *